United States Patent [19]

Conley et al.

[11] 4,079,766

[45] Mar. 21, 1978

[54] DRILL BIT

[76] Inventors: Beecher E. Conley, 2569 Butano Dr., Sacramento, Calif. 95821; Thomas M. Palmer, 4732 Arden Way, Carmichael, Calif. 95608

[21] Appl. No.: 744,884

[22] Filed: Nov. 24, 1976

[51] Int. Cl.[2] ..... B27G 15/00

[52] U.S. Cl. ..... 145/116 R; 408/224

[58] Field of Search ..... 145/116, 121, 122, 114; 408/212, 213, 223, 224, 227

[56] References Cited

U.S. PATENT DOCUMENTS

| | | | |
|---|---|---|---|
| 124,089 | 2/1872 | Shepardson | 408/212 |
| 298,786 | 5/1884 | Shaler | 408/213 |
| 421,293 | 2/1890 | Loftie | 408/224 |
| 1,365,660 | 1/1921 | Collier | 145/120 |
| 1,626,887 | 5/1927 | Spengler | 408/224 |
| 1,645,736 | 10/1927 | Blanch et al. | 145/121 |
| 2,230,645 | 2/1941 | Jones | 408/212 |
| 2,613,710 | 10/1952 | Emmons | 408/213 |
| 2,794,468 | 6/1957 | Huxtable | 408/224 |
| 2,962,066 | 11/1960 | Deliso | 408/224 |
| 3,360,025 | 12/1967 | Gallo | 408/224 |

FOREIGN PATENT DOCUMENTS

| | | | |
|---|---|---|---|
| 944,587 | 4/1949 | France | 408/212 |
| 11,776 | 11/1880 | Germany | 145/121 |
| 96,750 | 9/1939 | Sweden | 145/121 |
| 212,876 | 7/1924 | United Kingdom | 145/116 R |
| 17,756 | 8/1911 | United Kingdom | 408/223 |

*Primary Examiner*—James L. Jones, Jr.
*Assistant Examiner*—J. T. Zatarga
*Attorney, Agent, or Firm*—Blair & Brown

[57] ABSTRACT

A drill bit having a central shank having an "S" shaped cutter integrally formed on or detachably secured to the shank. A collar is detachably secured to the shank above the cutter and is keyed to the cutter to prevent rotation of the collar. A generally flat secondary cutter is secured to the collar and has a plurality of depending cutter elements on the peripheral edge thereof as well as a plurality of radially extending chisel cutters depending therefrom.

2 Claims, 7 Drawing Figures

FIG. 5.
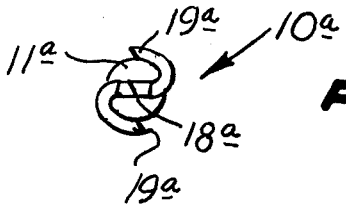
FIG. 4.
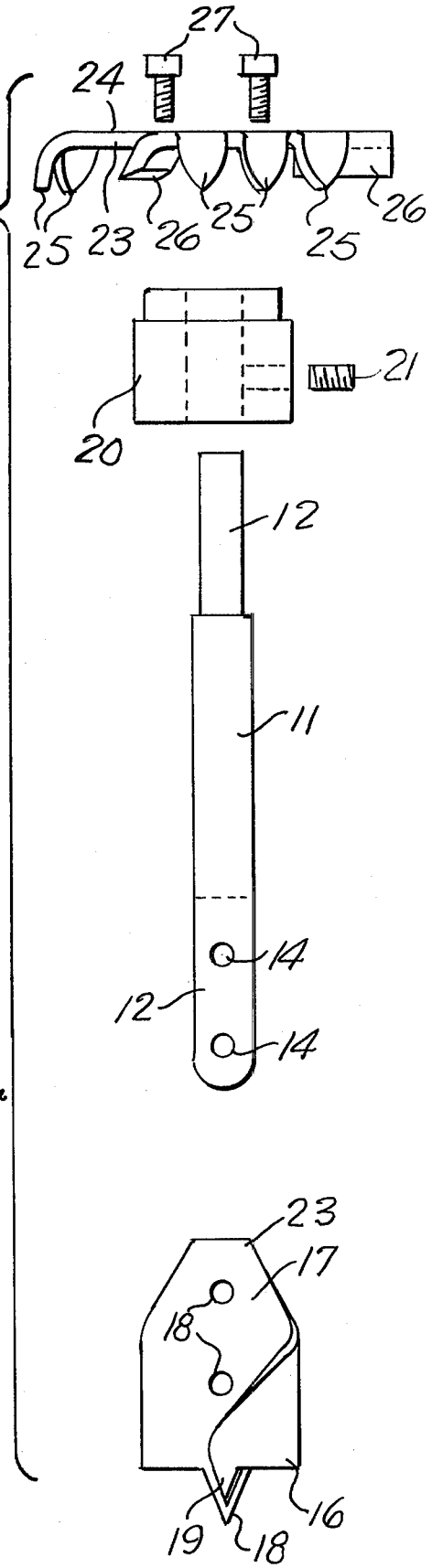
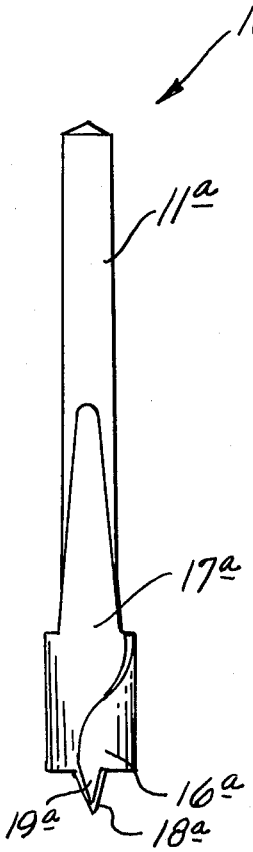
FIG. 6.
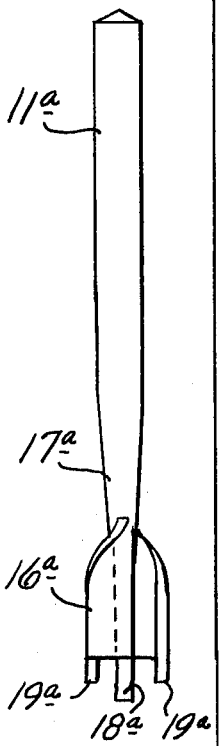
FIG. 7.

DRILL BIT

BACKGROUND OF THE INVENTION

Field of the Invention

The present invention relates to drill bits of the type for drilling holes in wood and similar materials.

SUMMARY OF THE INVENTION

A drill bit is provided in one form having an "S" shaped cutter integrally or detachably secured to one end of an elongate shank and the opposite end adapted to fit the chuck of an electric drill. Integrally formed on the "S" shaped cutter are an axial cutter point and a pair of outboard triangular cutting teeth on the opposite ends thereof. Integrally formed with and horizontally between the axial cutter point and outboard cutting teeth, is a chisel cutting surface.

In a second form of the invention, a secondary cutter is used with the "S" shaped cutter for drilling larger hole sizes. The secondary cutter is detachably secured to the shank below the "S" shaped cutter and is keyed to the cutter by a collar to prevent rotation of the secondary cutter on the shank. The collar is integrally or detachably secured to the generally flat secondary cutter. A plurality of depending cutter elements are located on the perpheral edge of the secondary cutter as well as a plurality of radially extending chisel cutters depending therefrom.

The primary object of the invention is to provide a drill bit which can cut a relatively large number of different sized holes utilizing interchangeable cutters thereon.

Still another object of the present invention is to provide drill bits and cutters that are relatively self aligning and will drill a smooth straight hole without danger of drifting or locking-up.

Other objects and advantages will become apparent in the following specification when considered in light of the attached drawings.

BRIEF DESCRIPTION OF THE DRAWINGS

FIG. 4 is an exploded side elevation of the invention;

FIG. 5 is a bottom plan view of a modified form of the invention;

FIG. 6 is a side elevation of the structure illustrated in FIG. 5; and

FIG. 7 is a front elevation of the structure illustrated in FIG. 5.

DESCRIPTION OF THE PREFERRED EMBODIMENTS

Figure 1:
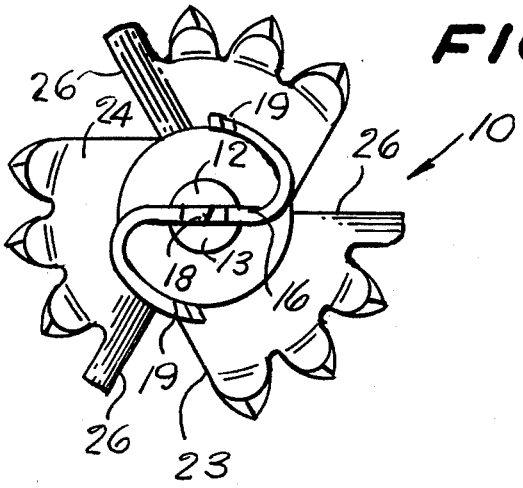
FIG. 1 is a bottom plan view of the invention.

Referring now to the drawings in detail, wherein like reference characters indicate like parts throughout the several figures, the reference numeral 10 indicates generally a drill bit constructed in accordance with the invention.

Figure 3:
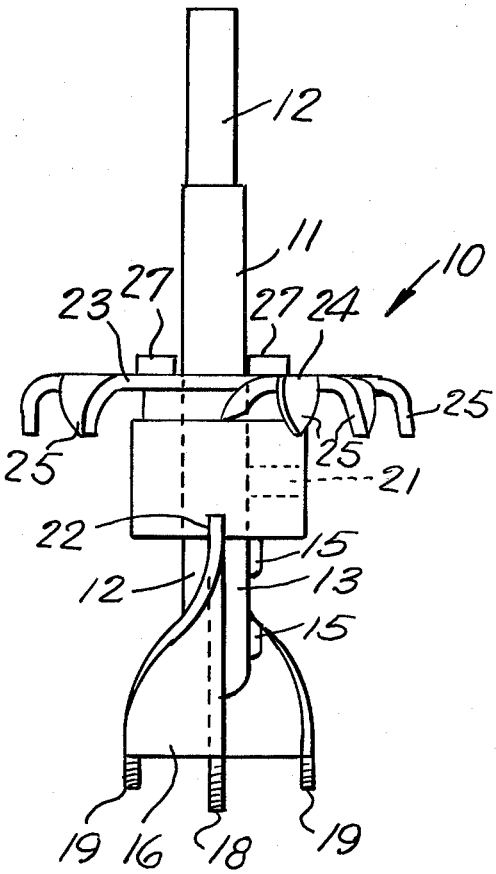
FIG. 3 is a front elevation of the invention.

The drill bit 10 includes an elongate shank 11 having a reduced diameter upper end portion 12 for mounting in the chuck of 1/25 inch drill. The lower end of the shaft 11 is bifurcated to provide a pair of spaced apart parallel legs 12, 13 as can be seen in FIG. 3. Bores 14 extend through the legs 12, 13 to receive securing elements 15 to extend therethrough.

Figure 2:
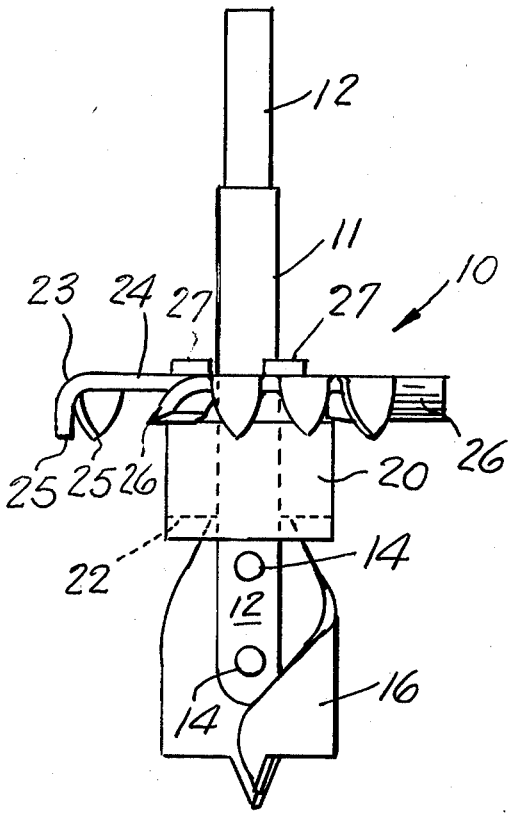
FIG. 2 is a side elevation of the invention.

An S-shaped bit 16 having a generally flat central portion 17 having a pair of spaced apart bores 18 extending therethrough is positioned between the legs 12, 13 and secured to the legs 12, 13 by the securing elements 15 as can be seen in FIGS. 2 and 3. The S-shaped bit 16 has a triangular center cutter 18 at the axial center thereof and a pair of triangular cutters 19 on opposite ends of the lower edge of the bit 16.

A collar 20 is detachably secured to the shaft 11 by means of a set-screw 21 and has a slot 22 extending radially of the lower face thereof to engage the upper portion 23 of the bit 16 as can be seen in FIG. 2 and 3 to prevent the collar 20 from rotating on the shaft 11 with respect to the bit 16. A cutter 23 consist of a central flat portion 24 having a plurality of depending cutter teeth 25 integrally formed thereon. A plurality of radially extending chisel teeth 26 are formed on the flat plate 24 for cutting away the material as the drill bit 10 is used. A pair of set-screws 27 extend through the flat plate 24 and secure the cutter 23 to the collar 20 as can be seen in FIGS. 2 and 3. In the use and operation of the invention a cutter 23 with its collar 20 is slipped onto the shaft 11 engaged with the bit 16 and locked by tightening the set-screw 21 so as to prepare the drill bit 10 to cut the desired hole. The drill bit 10 is then used in the conventional manner with an electric drill to drill the required hole. The cutters 23 are interchanged to select the cutter of the required hole size.

In FIGS. 5 through 7 a drill bit **10*a* has an elongate shaft 11*a* having a flatened end portion 17*a* formed into an S-shaped cutter 16*a***.

The cutter **16*a* includes an axial triangular cutting member 18*a* and a pair of outer triangular cutting members 19*a* all integrally formed with the elongate shank 11*a***.

In the use and operation of the cutter bit **10*a* illustrated in FIGS. 5 through 7 the cutter bit 10*a* replaces the shaft 11 with its attached cutter 16 of the preferred form of the invention. The elongate shank 11*a* is adapted to receive the collar 20 and cutter 23 illustrated in FIGS. 1 through 4** for use in the same manner as described above.

Having thus described the preferred embodiments of the invention it should be understood that numerous structural modifications and adaptations may be resorted to without departing from the spirit of the invention.

What is claimed is:

1. A drill bit comprising an elongate shaft, a substantially "S" shaped cutting tip having downwardly disposed triangular cutting points at the extremities of said "S" shaped cutting tip, and an axially disposed cutting tip located at the middle of said "S" shaped tip having a greater downward extent than said cutting tips at the extremities, a horizontal chiselling surface connecting said three tips along said "S", a collar overlying said shaft having a slightly less extent than said "S" cutter, retarded from slippage with said shaft by an interengaging set screw and by a collar slot which overlies a top portion of said "S" shaped cutter, and a secondary cutter attached to said collar having a horizontal plate and downwardly extending substantially triangular teeth at the outer periphery of said plate, and radially outwardly extending chiselling cutters disposed on the bottom face of said horizontal plate.

2. The device of claim 1 in which said "S" shaped cutter is removable from said shaft, and retention means comprises a shaft having a bifurcated extremity near said "S" shaped cutter having at least one hole extending therethrough and said "S" cutter has an upper portion having at least one hole therein for registry with said shaft hole which can slide in said bifurcated extremity and be fastened thereto.

* * * * *